US011053787B2

(12) United States Patent
Martysevich et al.

(10) Patent No.: US 11,053,787 B2
(45) Date of Patent: Jul. 6, 2021

(54) CONTROL OF FAR FIELD FRACTURE DIVERSION BY LOW RATE TREATMENT STAGE

(71) Applicant: Halliburton Energy Services, Inc., Houston, TX (US)

(72) Inventors: Vladimir Nikolayevich Martysevich, Spring, TX (US); Harold Grayson Walters, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 108 days.

(21) Appl. No.: 16/475,484

(22) PCT Filed: Mar. 2, 2017

(86) PCT No.: PCT/US2017/020505

§ 371 (c)(1),
(2) Date: Jul. 2, 2019

(87) PCT Pub. No.: WO2018/160183

PCT Pub. Date: Sep. 7, 2018

(65) Prior Publication Data

US 2021/0131253 A1 May 6, 2021

(51) Int. Cl.

| | |
|---|---|
| ***E21B 43/267*** | (2006.01) |
| ***E21B 43/12*** | (2006.01) |
| ***E21B 47/00*** | (2012.01) |
| *E21B 43/26* | (2006.01) |

(52) U.S. Cl.

CPC ..... *E21B 43/267* (2013.01); *E21B 43/12* (2013.01); *E21B 47/00* (2013.01); *E21B 43/26* (2013.01)

(58) Field of Classification Search

CPC ..... E21B 43/2607; E21B 43/26; E21B 43/25; E21B 43/267; E21B 43/12; E21B 47/00

See application file for complete search history.

(56) References Cited

U.S. PATENT DOCUMENTS

| | | | | |
|---|---|---|---|---|
| 5,595,245 | A * | 1/1997 | Scott, III | E21B 27/02 166/250.1 |
| 2006/0118301 | A1 | 6/2006 | East, Jr. et al. | |
| 2007/0023184 | A1 | 2/2007 | Jackson et al. | |
| 2009/0218094 | A1* | 9/2009 | McLeod | E21B 43/26 166/250.1 |
| 2015/0075779 | A1 | 3/2015 | Walters et al. | |
| 2015/0217672 | A1* | 8/2015 | Shampine | E21B 21/062 137/899.4 |

(Continued)

FOREIGN PATENT DOCUMENTS

WO 2018160183 A1 9/2018

*Primary Examiner* — Brad Harcourt
(74) *Attorney, Agent, or Firm* — Thomas Rooney; Parker Justiss, P.C.

(57) ABSTRACT

A fracturing controller, a method for controlling fracture diversion, and a hydraulic fracturing system are provided herein. One example of a method for controlling fracture diversion of a fracture during hydraulic fracturing, includes: (1) providing a first fracturing treatment for the fracture at a first pump rate, (2) subsequently providing a low rate treatment for the fracture at a reduced pump rate less than the first pump rate, and (3) changing the reduced pump rate based on proppant bridging in the fracture during the low rate treatment.

20 Claims, 5 Drawing Sheets

(56) References Cited

U.S. PATENT DOCUMENTS

| | | | | |
|---|---|---|---|---|
| 2016/0097260 | A1* | 4/2016 | Tolman | E21B 43/267 166/312 |
| 2016/0273346 | A1* | 9/2016 | Tang | E21B 47/06 |
| 2016/0348497 | A1 | 12/2016 | McEwen-King et al. | |
| 2017/0051599 | A1 | 2/2017 | Spurr et al. | |

* cited by examiner

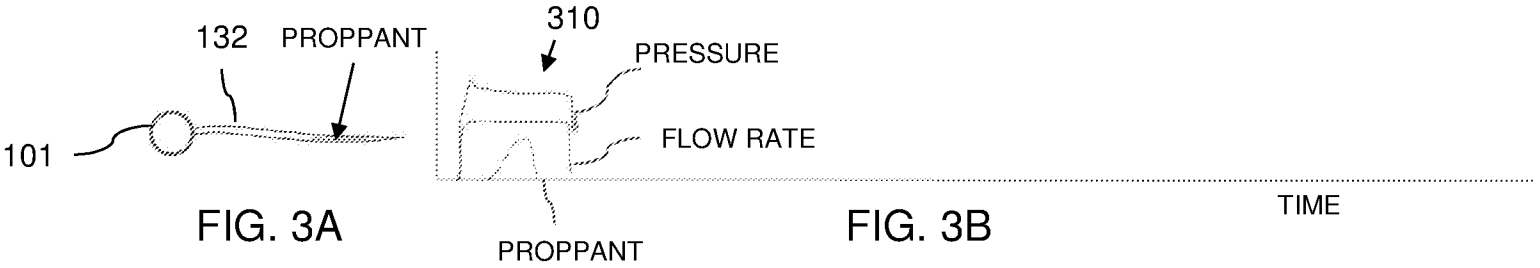
FIG. 3A
FIG. 3B
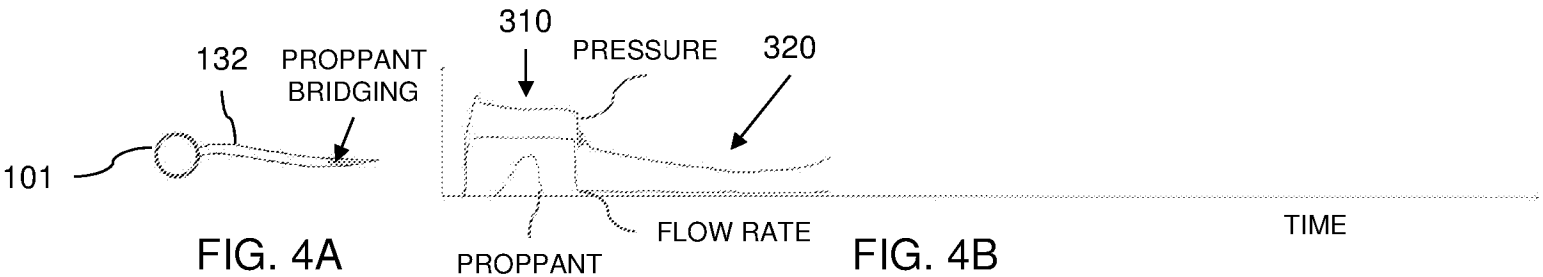
FIG. 4A
FIG. 4B
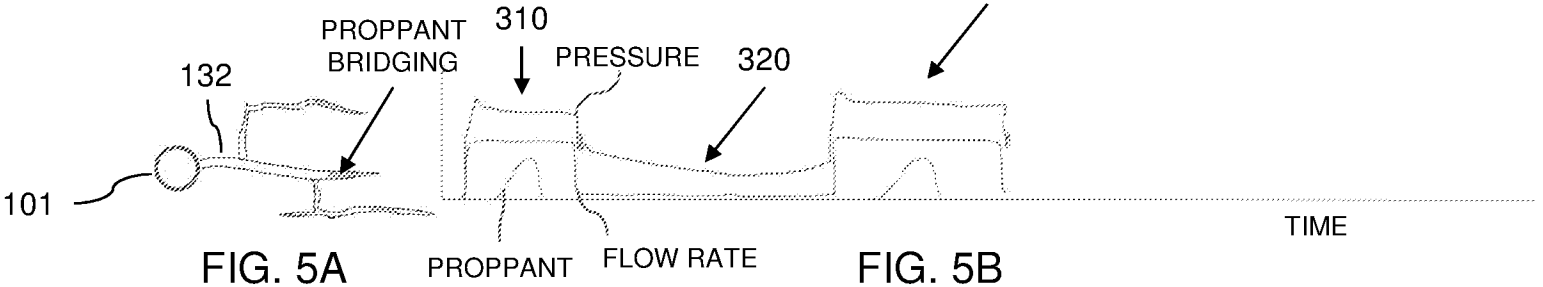
FIG. 5A
FIG. 5B

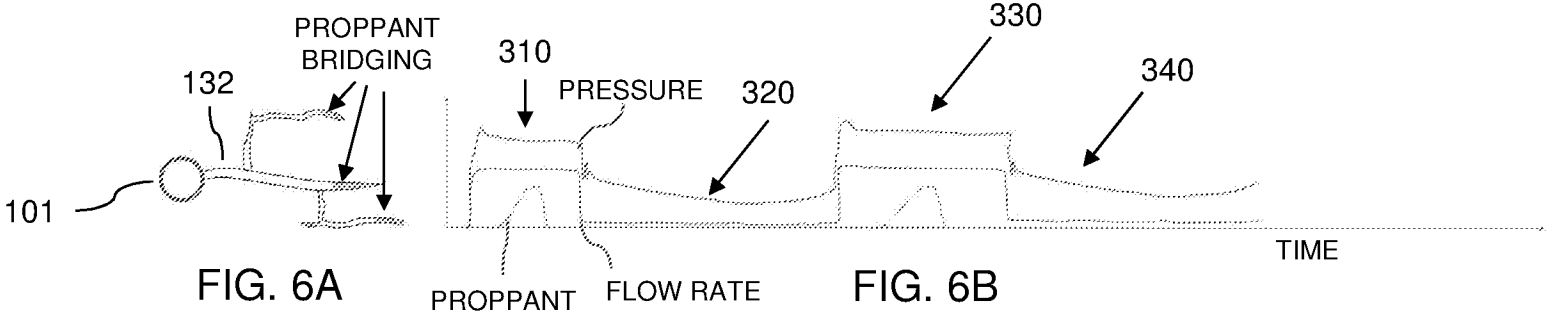
FIG. 6A
FIG. 6B
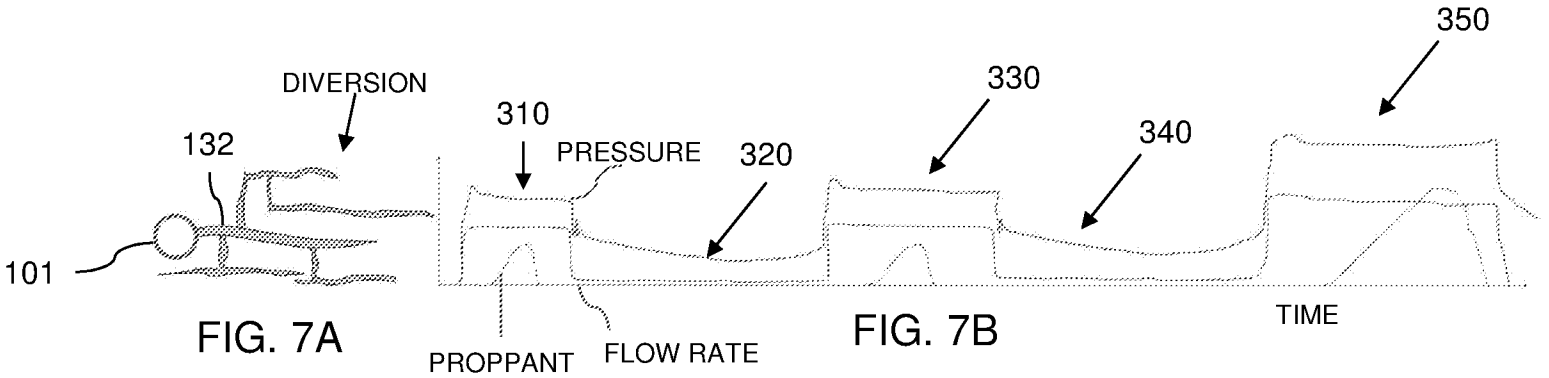
FIG. 7A
FIG. 7B

CONTROL OF FAR FIELD FRACTURE DIVERSION BY LOW RATE TREATMENT STAGE

CROSS-REFERENCE TO RELATED APPLICATION

This application is the National Stage of, and therefore claims the benefit of, International Application No. PCT/US2017/020505 filed on Mar. 2, 2017, entitled "CONTROL OF FAR FIELD FRACTURE DIVERSION BY LOW RATE TREATMENT STAGE," which was published in English under International Publication Number WO 2018/160183 on Sep. 7, 2018. The above application is commonly assigned with this National Stage application and is incorporated herein by reference in its entirety.

BACKGROUND

Hydraulic fracturing is often used to fracture subterranean formations, such as, shale, coal, and other types of rock formations in order to increase the flow of hydrocarbons. Hydraulic fracturing is a well-known process of fracture treatments that pump a fracturing or "fracking" fluid into a wellbore at an injection rate that is too high for the formation to accept without breaking. During injection the resistance to flow in the formation increases, the pressure in the wellbore increases to a value called the break-down pressure that is the sum of the in-situ compressive stress and the strength of the formation. Once the formation "breaks down," a fracture is formed, and the injected fracture fluid flows through it. The fracture fluids include a propping agent or proppant that is designed to keep an induced fracture open following a fracture treatment when the pressure in the fracture decreases below the compressive in-situ stress trying to close the fracture.

BRIEF DESCRIPTION

Reference is now made to the following descriptions taken in conjunction with the accompanying drawings, in which:

FIG. 3A to FIG. 7B illustrate an example of a process for increasing far field fracture complexity.

DETAILED DESCRIPTION

The complexity and geometry of a fracture can increase the effective permeability of a rock formation and affect the production of hydrocarbons. However, inducing far field fracture complexity and control of fracture geometry during a fracture treatment can be difficult. Accordingly, the disclosure provides a method to control far field fracture complexity and geometry by selectively placing proppant banks in the fractures by controlling proppant bridging. Controlling the proppant bridging can be either by accelerating or decelerating the proppant bridging. Proppant bridging is an accumulation or clumping of the proppant across a fracture width that restricts fluid flow into the hydraulic fracture. Proppant bridging can occur at fracture tips or at other locations of a fracture. Indications of proppant bridging can be based on fracturing monitoring information obtained or received during various fracture treatment stages. Disclosed examples advantageously use the recognition of proppant bridging during low rate treatment stages of hydraulic fracturing to control fracture diversion. Companies may employ the schemes and methods disclosed herein to charge for levels of diversion in fractures.

The methods, apparatuses, and systems disclosed herein can employ various indications or measurements to indicate the proppant bridging. One example includes determining proppant bridging based on treating pressure during fracture treatments. Various criteria can be used based on the treating pressure. For example, a rate of change of the slope of the treating pressure during a low rate treatment can be used to indicate proppant bridging. Additionally, a designated value of the treatment pressure during a low rate treatment stage can be used to indicate proppant bridging. Designated values can be determined by on historical data and wellbore parameters. In some embodiments, a treatment pressure can be noted during a high rate or fracturing treatment stage and then monitoring the during a low rate treatment to identify proppant bridging using known pressure decline analysis tools such as log-log plotting. In addition to the treatment pressure, other criteria, such as frequency component analysis, may be employed to determine proppant bridging or diversion conditions.

Figure 1:
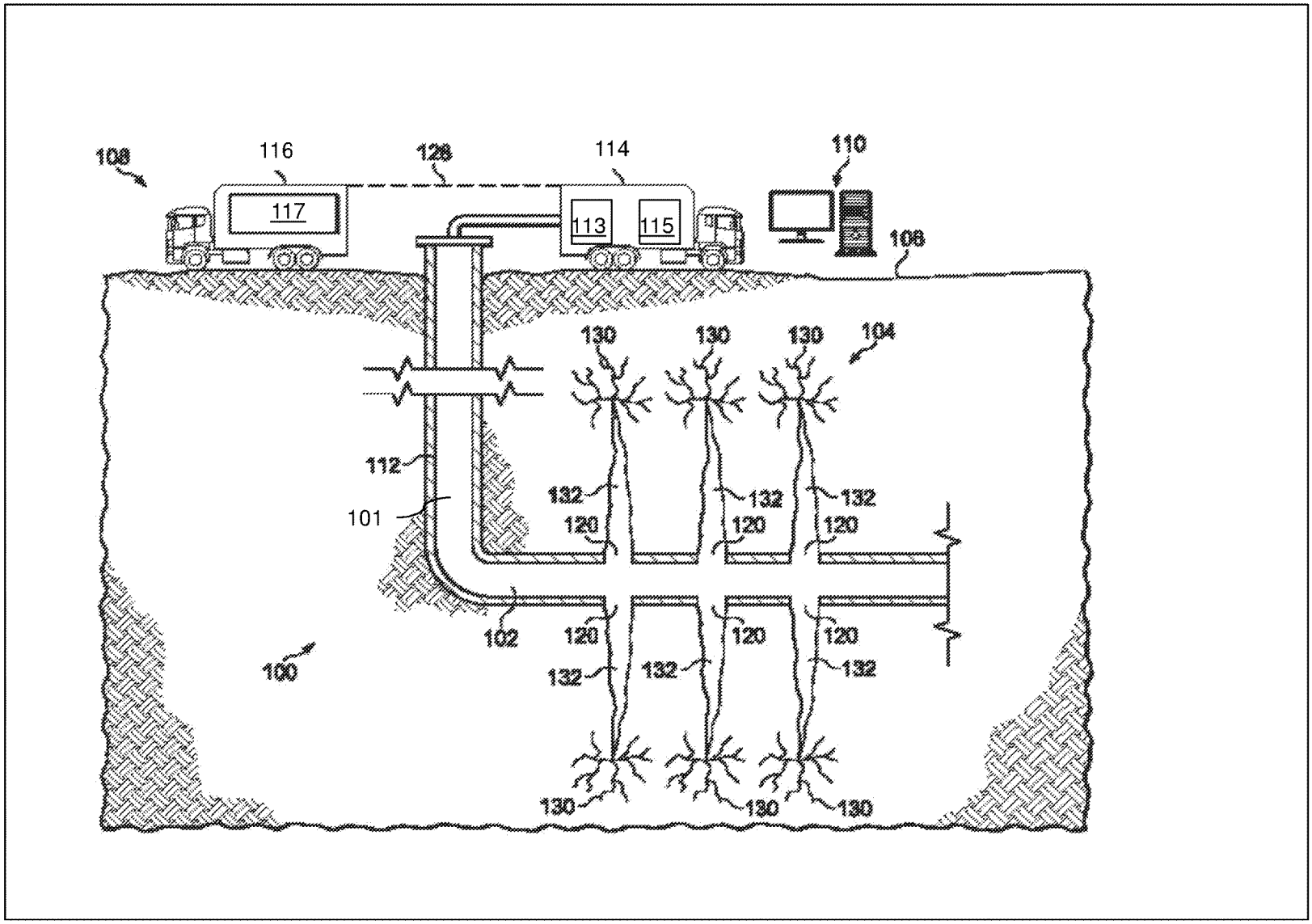
FIG. 1 illustrates a system diagram of an example well system having a fracturing system.

FIG. 1 illustrates a system diagram of an example well system 100 having a fracturing system 108. The well system 100 includes a wellbore 101 in a subterranean region 104 beneath the ground surface 106. The wellbore 101 includes a horizontal portion denoted 102 in FIG. 1. However, a well system may include any combination of horizontal, vertical, slant, curved, or other wellbore orientations. The well system 100 can include one or more additional treatment wells, observation wells, or other types of wells.

The subterranean region 104 may include a reservoir that contains hydrocarbon resources, such as oil, natural gas, or others. For example, the subterranean region 104 may include all or part of a rock formation (e.g., shale, coal, sandstone, granite, or others) that contains natural gas. The subterranean region 104 may include naturally fractured rock or natural rock formations that are not fractured to any significant degree. The subterranean region 104 may include tight gas formations that include low permeability rock (e.g., shale, coal, or others).

The well system 100 further includes a computing system 110 that includes one or more computing devices or systems located at the wellbore 101 or at other locations. Thus, the computing system 110 can be a distributed system having components located apart from the components illustrated in FIG. 1. For example, the computing subsystem 110 or portions thereof can be located at a data processing center, a computing facility, or another suitable location. The well system 100 can include additional or different features, and the features of the well system can be arranged as shown in FIG. 1 or in another configuration.

The fracturing system 108 can be used to perform a fracturing treatment or treatments of hydraulic fracturing whereby fracture fluid is injected into the subterranean region 104 to fracture part of a rock formation or other materials in the subterranean region 104. In such examples, fracturing the rock may increase the surface area of the formation, which can increase the rate at which the formation conducts resources to the wellbore 101.

In some instances, the fracturing system 108 can apply fracturing treatments at multiple different fluid injection locations in a single wellbore, multiple fluid injection locations in multiple different wellbores, or any suitable combination. Moreover, the fracturing system 108 can inject fracturing fluid through any suitable type of wellbore, such as, for example, vertical wellbores, slant wellbores, horizontal wellbores, curved wellbores, or combinations of these and others.

The fracturing system 108 includes pump trucks 114, a pump controller 115, instrument trucks 116, a fracturing controller 117, and a communication link 128. The well system 100 or the fracturing system 108 specifically can include multiple uncoupled communication links or a network of coupled communication links that include wired or wireless communications systems, or a combination thereof. The fracturing system 108 may include other features typically included with a fracturing system that are not illustrated in the figures provided herewith. For example, the fracturing system 108 may also include surface and downhole sensors to measure pressure, rate, temperature or other parameters of fracture treatments. The pressure sensors or other equipment that measure pressure can be used to measure the treating pressure of the fracture fluids in the wellbore 101 at or near the ground surface 106 level or at other locations in the subterranean region 104.

The fracturing system 108 may apply different types of fracture treatment stages and can apply the different types of stages multiple times. For example, the fracturing system 108 can apply fracturing treatment stages and low rate treatment stages. A fracturing treatment stage is created by injecting a fracture fluid, such as a polymer gelled-water slurry with sand proppant, down a wellbore, such as wellbore 101, and into a targeted reservoir interval at an injection rate and pressure sufficient to cause the reservoir rock within the selected depth interval to fracture in a perpendicular plane passing through the wellbore. A proppant in the fracturing fluid is used to prevent fracture closure after completion of the fracturing treatment. A low rate treatment stage is when the fracturing fluid is injected down the wellbore at a reduced pump rate that allows fractures to start closing (the injecting fluid volume is less than the fluid volume leaking through created fracture(s) faces). The pump trucks 114 can be used to pump the fracture fluid into the wellbore 101.

The pump trucks 114 can include mobile vehicles, immobile installations, skids, hoses, tubes, fluid tanks, fluid reservoirs, pumps, valves, mixers, or other types of structures and equipment. One pump, pump 113, is illustrated in FIG. 1. The fracturing system 108 includes a pump controller 115 for starting, stopping, increasing, decreasing or otherwise controlling pumping of the fracture fluid during the fracturing treatments. The pump controller 115 is communicatively coupled to the pump 113 and can be located in the pump trucks 114 as illustrated in FIG. 1 or in another location. The pump trucks 114 shown in FIG. 1 can supply fracture fluid or other materials for the fracture treatments. The pump trucks 114, including the pump 113, can communicate fracture fluids into the wellbore 101 at or near the level of the ground surface 106. The fracture fluids can be communicated through the wellbore 101 from the ground surface 106 level by a conduit 112 installed in the wellbore 101. The conduit 112 may include casing cemented to the wall of the wellbore 101. In some implementations, all or a portion of the wellbore 101 may be left open, without casing. The conduit 112 may include a working string, coiled tubing, sectioned pipe, or other types of conduit.

The instrument trucks 116 can include mobile vehicles, immobile installations, or other suitable structures. The instrument trucks 116 shown in FIG. 1 include the fracturing controller 117 that controls or monitors the fracture treatments applied by the fracturing system 108. The communication link 128 may allow the instrument trucks 116 to communicate with the pump trucks 114, or other equipment at the ground surface 106. Via the communication links 128 the fracturing controller 117 can communicate with the pump controller 115 to control a flow rate of the fracture fluid into the wellbore 101 and initiate different fracture treatments. Additional communication links may allow the instrument trucks 116 and the fracturing controller 117 to communicate with sensors or data collection devices in the well system 100, remote systems, other well systems, equipment installed in the wellbore 101 or other devices and equipment to collect fracturing monitoring information. The fracturing controller 117 can initiate various fracture treatment stages or vary the flow rate of the fracture fluid based on the fracturing monitoring information from the various sensors and data collection devices. For example, the fracturing controller 117 can direct the pump controller 115 to change the flow rate of the fracture fluid, via the pump 113, into the wellbore 101 during a fracture treatment, based on a treatment pressure received from a pressure sensor. Treatment pressure is a kind of pressure that represents pressure behavior in the fracture during the treatment, such as, a pressure acquired from a wellhead pressure sensor or from a downhole pressure sensor. The fracture treatment can be a low rate treatment stage.

The fracture controller 117 shown in FIG. 1 controls operation of the fracturing system 108. The fracturing controller 117 may include data processing equipment, communication equipment, or other systems that control fracture treatments applied to the subterranean region 104 through the wellbore 101. The fracturing controller 117 may be communicably linked to the computing subsystem 110 that can calculate, select, or optimize fracture treatment parameters for initialization, propagation, or opening fractures in the subterranean region 104. The fracturing controller 117 may receive, generate or modify an injection treatment plan (e.g., a pumping schedule) that specifies properties of a fracture treatment to be applied to the subterranean region 104.

In the example shown in FIG. 1, a fracture treatment has fractured the subterranean region 104. FIG. 1 shows examples of dominant fractures 132 formed by fracture fluid injection through perforations 120 along the wellbore 101. Generally, the fractures can include fractures of any type, number, length, shape, geometry or aperture. Fractures can extend in any direction or orientation, and they may be formed at multiple stages or intervals, at different times or simultaneously. In addition to the dominant fractures 132, FIG. 1 also illustrates fracture diversions 130 having an increased complexity compared to the dominant fractures 132. The fracture controller 117 can control the complexity and geometry of fractures by selectively placing proppant banks in the fractures 130, 132, through the acceleration or deceleration of proppant bridging employing the fracture monitoring information, such as pressure. In some cases, the fracturing controller 117 can control the fracture treatments based on data obtained from the well system 100, such as from pressure meters, flow monitors, microseismic equipment, tiltmeters, or other equipment that can perform measurements before, during, or after a fracture treatment. In some cases, the fracturing controller 117 can select or modify (e.g., increase or decrease) fluid pressures, fluid densities, fluid compositions, and other control parameters based on data provided by the various sensors or measuring devices. In some instances, fracturing monitoring information or portions thereof can be displayed in real time during fracture treatments to, for example, an engineer or other operator of the well system 100. The fracturing monitoring information can be displayed at the fracturing controller 117 or via another display communicatively coupled to the fracturing system 108. The engineer or other operator can use the received information to direct the fracture treatments. The engineer or operator can control the fracture treatments according to the methods and schemes disclosed herein.

Figure 2:
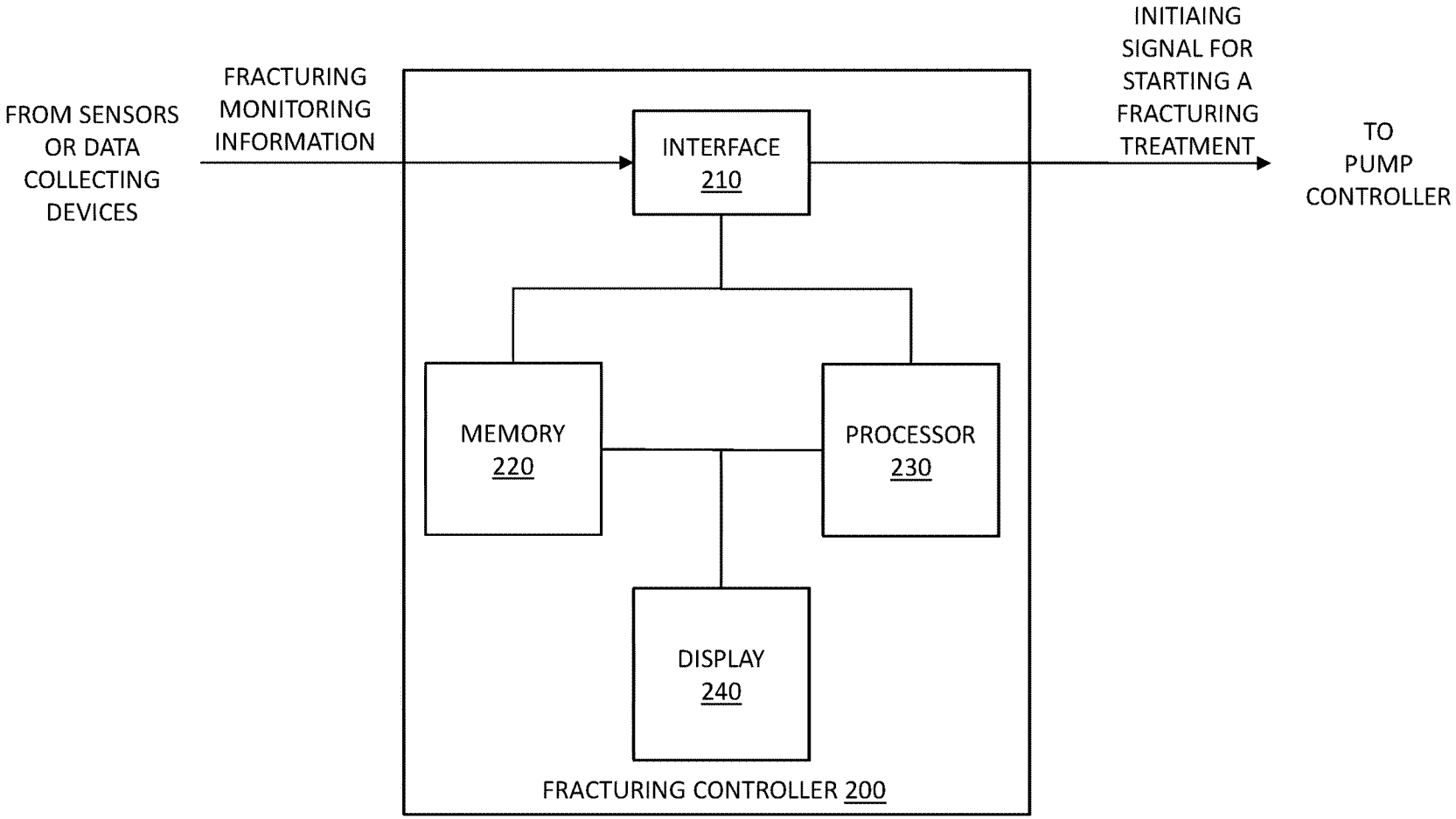
FIG. 2 illustrates a block diagram of an example of a fracturing controller.

FIG. 2 illustrates a block diagram of an example of a fracturing controller 200. The fracturing controller 200 manages the application of fracture treatments to a subterranean region and controls the complexity and geometry of far field fractures through the acceleration and deceleration of proppant bridging. The fracturing controller 200 includes an interface 210, a memory 220, a processor 230, and a display 240. The fracturing controller 200 can be located at a well site and be part of a fracturing system. In some embodiments, the fracturing controller 200 can be located remotely from a well site and connected to components at the well site via a communications network. The fracturing controller 200 may be the fracturing controller 117 illustrated in FIG. 1. The interface 210, the memory 220, the processor 230, and the display 240 can be connected together via conventional means.

The interface 210 is configured to receive fracturing monitoring information before, during, or after the application of a fracture treatment. The fracturing monitoring information can include pump rate, flow rate, and pressure measurements of a wellbore during the various stages of hydraulic fracturing. The fracturing monitoring information includes proppant bridging indicators. In some embodiments, the pressure measurements can be used as a proppant bridging indicator.

The interface 210 can be a conventional interface that is used to receive and transmit data. The interface 210 can include multiple ports, terminals or connectors for receiving or transmitting the data. The ports, terminals or connectors may be conventional receptacles for communicating data via a communications network.

The memory 220 may be a conventional memory that is constructed to store data and computer programs. The memory 220 may store operating instructions to direct the operation of the processor 230 when initiated thereby. The operating instructions may correspond to algorithms that provide the functionality of the operating schemes disclosed herein. For example, the operating instructions may correspond to the algorithm or algorithms that control far field fracture complexity and geometry by controlling proppant bridging in a fracture. The operating instructions can determine the occurrence of proppant bridging, for example, by automatically calculating from received pressure measurements a positive slope increase of a treating pressure during a low rate treatment stage. Based on this determination, the fracturing controller 200 can generate an initiating signal for a fracturing treatment stage. In one embodiment, the memory 220 or at least a portion thereof is a non-volatile memory.

The processor 230 is configured to initiate a fracturing treatment stage of hydraulic fracturing based on receiving or determining an indication of proppant bridging in a fracture during a low rate treatment stage of the hydraulic fracturing. The processor 230 can initiate a fracturing treatment stage by sending an initiating signal to a pump controller. The initiating signal can instruct the pump controller to increase the pump rate of a pump that is injecting fracture fluid into a wellbore. In one embodiment, the memory 220 or a portion thereof can be part of the processor 230.

The display 240 is configured to provide a visual indication of proppant bridging. The display 240 can provide a visual representation of the fracturing monitoring information. In some embodiments, an engineer or operator can determine the occurrence of proppant bridging based on the fracturing monitoring information provided by the display 240. For example, the display 240 may provide a graph of the treating pressure during a low rate treatment stage that indicates an increase in treating pressure. The engineer or operator can manually initiate another fracturing treatment based on the visual representation of the treating pressure. FIGS. 3A-7B illustrate an example of graphs that may be provided by the display 240.

FIG. 3A to FIG. 7B illustrate a process for increasing far field fracture complexity according to the disclosure. The process is illustrated by looking at a wellbore (cross section thereof) having a fracture extending therefrom and a graph showing the corresponding fracture treatment stages. For simplicity, a single wing of created fractures is represented in FIG. 3A to FIG. 7B while usually bi-winged fractures are observed during the process. The wellbore cross sections can be either horizontal or vertical depending on the orientation of the wellbore section. Wellbore 101 and one of the fractures 132 from FIG. 1 are used FIGS. 3A-7B. The complexity of the fracture 132, represented by diversion 130 in FIG. 1, is developed through FIGS. 3A-7B by controlling proppant bridging in the fracture 132. The fracture can be a far field fracture and the complexity can be in a lateral or vertical direction. The process can be controlled automatically by a fracturing controller, such as fracturing controller 200, or by an engineer or operator in response to fracturing monitoring data. FIGS. 3A-7B, include an A section having the wellbore 101 and fracture 132 and a B section having the graph. The graphs have an x axis that is a time axis and a y axis for treating pressure, flow rate of the fracture fluid during fracture treatments, and proppant concentration in the fracturing fluid in the fracture. The graphs do not have a scale on the x and y axis.

In FIG. 3A and FIG. 3B, a short fracturing treatment 310 is performed and a diverter material is placed in the fracture 130. In FIG. 4A and FIG. 4B, the flow rate of the fracture fluid is reduced and a low rate treatment stage 320 is provided. During the low rate treatment stage 320, the treating pressure begins to increase at the moment the proppant bank starts bridging. The proppant bank can occur at the tip of the fracture 132 as illustrated or at another location of the fracture 132. Changing the flow rate at the moment of proppant bridging allows the fracture geometry of the fracture 132 to be controlled.

In FIG. 5B, the flow rate is increased and a second fracturing treatment 330 stage is delivered to the wellbore 101. As illustrated in FIG. 5A, the complexity of the fracture 132 is increased as additional fingers are created by the second fracturing treatment 330 that places additional proppant.

Turning to FIG. 6B, a second low rate treatment 340 stage is delivered to the wellbore 101 after the second fracturing treatment 330. During the low rate treatment 340, the treating pressure increases indicating additional proppant bridging as shown in FIG. 6A. As shown in FIG. 7B, a third fracturing treatment 350 stage is then delivered to the wellbore 101. During the third fracturing treatment 350, fracture diversion is created, proppant is distributed through the fracture 132 as shown in FIG. 7A, and fracture treatments are halted. One skilled in the art will understand that more or less low rate treatments and fracturing treatment stages can be delivered to a fracture. In some embodiments, the number of fracturing treatments delivered can be determined by the amount a client pays for or requests.

FIGS. 3A-7B illustrate that pumping of a fracture fluid is not stopped, but the rate of bridging is controlled through pump rate changes to create diversion in the fracture 132 with additional contiguous fracturing treatments which include proppant. In FIGS. 3A-7B monitoring of treating pressure is used to indicate proppant bridging. In addition to simple treating pressure monitoring, more sophisticated frequency component analysis may be employed to determine a bridging and/or diversion condition. For example, a signal could be induced downhole and a return wave analyzed to determine proppant bridging.

Figure 8:
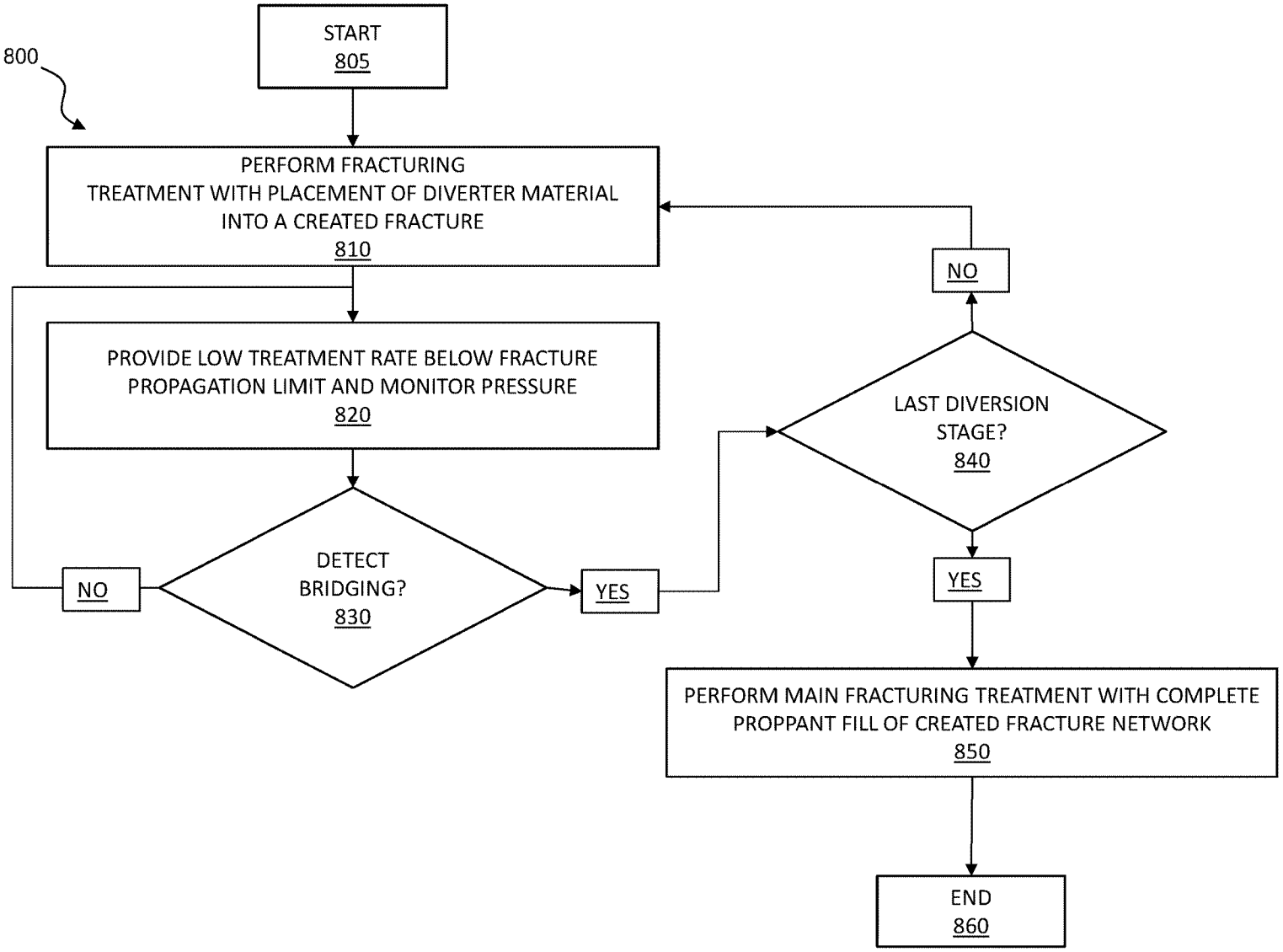
FIG. 8 illustrates a flow diagram of an example of a method for controlling fracture diversion of a fracture during hydraulic fracturing.

FIG. 8 illustrates a flow diagram of an example of a method 800 for controlling fracture diversion of a fracture during hydraulic fracturing. The already created fracture can be a far field fracture. The method 800 can be automatically directed or performed by a fracturing controller. The method 800 begins in a step 805.

In a step 810, a fracturing treatment is performed that places a diverter material into a created fracture. During this first fracturing treatment, the diverter material is pumped into the wellbore at a first pump rate.

Subsequent to the first fracturing treatment, a low rate treatment for the fracture is provided in a step 820. The low rate treatment is provided below the fracture propagation limit and the treating pressure during the low rate treatment is monitored. During this low rate treatment, the fracture fluid is delivered to the wellbore at a reduced pump rate less than the first pump rate.

In a determination step 830, a decision is made if bridging is detected in the fracture. The proppant bridging can be detected based on the treating pressure during the low rate treatment. For example, an increase in the treating pressure during the low rate treatment stage can be used to indicate the bridging of the proppant. The proppant bridging can also be indicated through analyzing a wave induced in the wellbore during the fracture treatments. If no bridging is detected, the method 800 continues to step 820 where the low rate treatment for the fracture is provided.

If bridging is detected in step 830, the method 800 continues to determination step 840 where a decision is made if this is the last diversion stage. If not, the method 800 continues to step 810 where a fracturing treatment is performed that places diverter material in the fracture for increasing diversion. The reduced pump rate used for the low rate treatment is changed based on proppant bridging and the determination to provide another diversion stage. During this diversion stage in step 810, the diverter material can be placed in the fracture at a second pump rate greater than reduced rate and the first pump rate.

The decision in step 840 can be based on if a client has paid for a certain number of fracturing treatments or pairs of low rate treatments and fracturing treatments. The decision can be based on saturation of the proppant in the fracture.

If a determination is made that this is the last diversion stage, then the method 800 continues to step 850 wherein the main fracturing treatment is performed with a complete proppant fill of the created fracture network. The method 800 then continues to step 860 and ends.

While the methods disclosed herein have been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

Those skilled in the art to which this application relates will appreciate that other and further additions, deletions, substitutions and modifications may be made to the described embodiments.

Some of the techniques and operations described herein may be implemented by a one or more computing systems configured to provide the functionality described. In various instances, a computing system may include any of various types of devices, including, but not limited to, personal computer systems, desktop computers, laptops, notebooks, mainframe computer systems, handheld computers, workstations, tablets, application servers, computer clusters, storage devices, or any type of computing or electronic device.

The above-described system, apparatus, and methods or at least a portion thereof may be embodied in or performed by various processors, such as digital data processors or computers, wherein the computers are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods or functions of the system or apparatus described herein.

Certain embodiments disclosed herein can further relate to computer storage products with a non-transitory computer-readable medium that have program code thereon for performing various computer-implemented operations that embody the apparatuses, the systems or carry out the steps of the methods set forth herein. Non-transitory medium used herein refers to all computer-readable media except for transitory, propagating signals. Examples of non-transitory computer-readable medium include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

Embodiments disclosed herein include:

A. A fracturing controller for hydraulic fracturing of subterranean regions, including an interface configured to receive fracturing monitoring information of a fracture in a subterranean region undergoing hydraulic fracturing using a fracture fluid having a proppant, and a processor configured to initiate a fracturing treatment stage of the hydraulic fracturing based on receiving an indication of proppant bridging in the fracture during a low rate treatment stage of the hydraulic fracturing.

B. A method for controlling fracture diversion of a fracture during hydraulic fracturing, including providing a first fracturing treatment for the fracture at a first pump rate, subsequently providing a low rate treatment for the fracture at a reduced pump rate less than the first pump rate, and changing the reduced pump rate based on proppant bridging in the fracture during the low rate treatment.

C. A hydraulic fracturing system, including a pump for injecting fracture fluid having a proppant in a wellbore, a pump controller configured to direct operation of the pump, and a fracturing controller for hydraulic fracturing of subterranean regions, having an interface configured to receive an indication of proppant bridging in a fracture undergoing hydraulic fracturing, and a processor configured to change a pump rate of the fracture fluid via the pump controller and the pump based on receiving an indication of proppant bridging during a low rate treatment stage of the hydraulic fracturing.

Each of embodiments A, B, and C may have one or more of the following additional elements in combination:

Element 1: wherein the fracturing treatment stage is a subsequent fracturing treatment stage and the hydraulic fracturing includes an initial fracturing treatment stage before the low rate treatment stage. Element 2: wherein the processor is configured to apply the subsequent fracturing treatment stage at a higher pump rate than a pump rate of the initial fracturing treatment stage. Element 3: wherein the processor is configured to initiate multiple fracturing treatment stages in response to proppant bridging indications from different low rate treatment stages of the hydraulic fracturing. Element 4: wherein the fracture is a far field fracture. Element 5: wherein the indication of the proppant bridging is based on a treating pressure during the hydraulic fracturing. Element 6: wherein the indication of the proppant bridging is based on an increase in a treating pressure during the low rate treatment. Element 7: wherein the proppant bridging is indicated by an increase in a treating pressure during the low rate treatment. Element 8: wherein the changing includes providing a second fracturing treatment at a second pump rate greater than the reduced pump rate. Element 9: further comprising providing a second low rate treatment subsequent the second fracture treatment and a third fracture treatment for the fracture based on proppant bridging in the fracture during the second low rate treatment. Element 10: wherein a pump rate of the second fracture treatment is greater than a pump rate of the first fracturing treatment and a pump rate of the third fracturing treatment is greater than the pump rate of the second fracturing treatment. Element 11: wherein the proppant bridging is indicated by a treating pressure of the hydraulic fracturing. Element 12: wherein the indication is based on a treating pressure of the hydraulic fracturing. Element 13: wherein the indication is based on a slope of a treating pressure of the hydraulic fracturing during the low rate treatment. Element 14: wherein the processor is configured to initiate a fracturing treatment in response to the indication of the proppant bridging. Element 15: wherein the processor is configured to initiate multiple fracturing treatments based on the indication of proppant bridging. Element 16: wherein the processor is configured to determine the proppant bridging based on a value of a treating pressure.

What is claimed is:

1. A fracturing controller for hydraulic fracturing of subterranean regions, comprising:

an interface configured to receive fracturing monitoring information of a fracture in a subterranean region undergoing hydraulic fracturing using a fracture fluid having a proppant; and a processor configured to increase diversion of said fracture by initiating a fracturing treatment stage of said hydraulic fracturing based on receiving an indication of proppant bridging in said fracture during a low rate treatment stage of said hydraulic fracturing.

2. The fracturing controller as recited in claim 1 wherein said fracturing treatment stage is a subsequent fracturing treatment stage and said hydraulic fracturing includes an initial fracturing treatment stage before said low rate treatment stage.

3. The fracturing controller as recited in claim 2 wherein said processor is configured to apply said subsequent fracturing treatment stage at a higher pump rate than a pump rate of said initial fracturing treatment stage.

4. The fracturing controller as recited in claim 1 wherein said processor is configured to initiate multiple fracturing treatment stages in response to proppant bridging indications from different low rate treatment stages of said hydraulic fracturing.

5. The fracturing controller as recited in claim 1 wherein said fracture is a far field fracture.

6. The fracturing controller as recited in claim 1 wherein said indication of said proppant bridging is based on a treating pressure during said hydraulic fracturing.

7. The fracturing controller as recited in claim 1 wherein said indication of said proppant bridging is based on an increase in a treating pressure during said low rate treatment.

8. A method for controlling fracture diversion of a fracture during hydraulic fracturing, comprising:

providing a first fracturing treatment for said fracture at a first pump rate;

subsequently providing a low rate treatment for said fracture at a reduced pump rate less than said first pump rate; and increasing diversion of said fracture by changing said reduced pump rate based on proppant bridging in said fracture during said low rate treatment.

9. The method as recited in claim 8 wherein said proppant bridging is indicated by an increase in a treating pressure during said low rate treatment.

10. The method as recited in claim 8 wherein said fracture is a far field fracture.

11. The method as recited in claim 8 wherein said changing includes providing a second fracturing treatment at a second pump rate greater than said reduced pump rate.

12. The method as recited in claim 11 further comprising providing a second low rate treatment subsequent said second fracture treatment and a third fracture treatment for said fracture based on proppant bridging in said fracture during said second low rate treatment.

13. The method as recited in claim 12 wherein a pump rate of said second fracture treatment is greater than a pump rate of said first fracturing treatment and a pump rate of said third fracturing treatment is greater than said pump rate of said second fracturing treatment.

14. The method as recited in claim 8 wherein said proppant bridging is indicated by a treating pressure of said hydraulic fracturing.

15. A hydraulic fracturing system, comprising:

a pump for injecting fracture fluid having a proppant in a wellbore;

a pump controller configured to direct operation of said pump; and a fracturing controller for hydraulic fracturing of subterranean regions, including:

an interface configured to receive an indication of proppant bridging in a fracture undergoing hydraulic fracturing; and a processor configured to increase diversion of said fracture by increasing a pump rate of said fracture fluid via said pump controller and said pump based on receiving an indication of proppant bridging during a low rate treatment stage of said hydraulic fracturing.

16. The hydraulic fracturing system as recited in claim 15 wherein said indication is based on a treating pressure of said hydraulic fracturing.

17. The hydraulic fracturing system as recited in claim 15 wherein said indication is based on a slope of a treating pressure of said hydraulic fracturing during said low rate treatment.

18. The hydraulic fracturing system as recited in claim 15 wherein said processor is configured to initiate a fracturing treatment in response to said indication of said proppant bridging.

19. The hydraulic fracturing system as recited in claim 15 wherein said processor is configured to initiate multiple fracturing treatments based on said indication of proppant bridging.

20. The hydraulic fracturing system as recited in claim 15 wherein said processor is configured to determine said proppant bridging based on a value of a treating pressure.

* * * * *